US010203186B2

(12) United States Patent
Yehle et al.

(10) Patent No.: US 10,203,186 B2
(45) Date of Patent: Feb. 12, 2019

(54) HIGH IMPACT STRENGTH LIGHTED NOCK ASSEMBLY

(71) Applicant: Ravin Crossbows, LLC, Superior, WI (US)

(72) Inventors: Craig Yehle, Winona, MN (US); Fred Hunt, Athol, ID (US); Larry Pulkrabek, Osceola, IA (US)

(73) Assignee: Ravin Crossbows, LLC, Superior, WI (US)

( * ) Notice: Subject to any disclaimer, the term of this patent is extended or adjusted under 35 U.S.C. 154(b) by 0 days.

(21) Appl. No.: 15/631,016

(22) Filed: Jun. 23, 2017

(65) Prior Publication Data

US 2018/0231359 A1 Aug. 16, 2018

Related U.S. Application Data

(60) Provisional application No. 62/492,671, filed on May 1, 2017, provisional application No. 62/459,421, filed on Feb. 15, 2017.

(51) Int. Cl.

| | |
|---|---|
| ***F42B 6/06*** | (2006.01) |
| ***F42B 12/36*** | (2006.01) |
| ***F42B 12/42*** | (2006.01) |
| ***F42B 12/38*** | (2006.01) |
| ***F42B 6/04*** | (2006.01) |

(52) U.S. Cl.

CPC ..... *F42B 6/06* (2013.01); *F42B 6/04* (2013.01); *F42B 12/362* (2013.01); *F42B 12/38* (2013.01); *F42B 12/382* (2013.01); *F42B 12/385* (2013.01); *F42B 12/42* (2013.01)

(58) Field of Classification Search

CPC ..... F42B 6/06; F42B 12/362; F42B 12/38; F42B 12/382; F42B 12/42

USPC ..... 473/570, 578

See application file for complete search history.

(56) References Cited

U.S. PATENT DOCUMENTS

| | | | |
|---|---|---|---|
| 4,305,588 | A | 12/1981 | Dodge |
| 4,340,930 | A | 7/1982 | Carissimi |
| 4,544,163 | A | 10/1985 | Scanlon |
| 4,547,837 | A | 10/1985 | Bennett |
| 4,645,211 | A | 2/1987 | Beiter |
| 4,722,318 | A | 2/1988 | Yankey |
| D301,272 | S | 5/1989 | Barrow et al. |
| 5,067,731 | A | 11/1991 | Bickel |

(Continued)

OTHER PUBLICATIONS

2012 Firenock Catalog (12 pages) www/firenock.com.

(Continued)

*Primary Examiner* — Alexander Niconovich

(57) ABSTRACT

A high impact strength lighted nock assembly for an arrow that is activated when the arrow is fired with a bowstring. The lighted nock assembly includes a nock molded from a high impact strength, transparent polymeric material containing at least 10% by weight reinforcing fibers. The nock includes a head configured to engage with the bowstring and a shank configured to couple with a rear end of the arrow. The shank includes a recess extending in a distal end of the shank toward the head. A light assembly including a light emitting device is located in the recess in the shank that is electrically coupled to a battery. A switch is electrically coupled to the light emitting device and the battery that is triggered when the arrow is fired to activate the light emitting device.

19 Claims, 13 Drawing Sheets

(56) References Cited

U.S. PATENT DOCUMENTS 5,134,552 A 7/1992 Call
5,154,432 A 10/1992 Sanders
5,290,044 A 3/1994 Easton et al.
5,306,019 A 4/1994 Guest et al.
5,417,439 A 5/1995 Bickel
5,439,231 A 8/1995 Roberts et al.
5,547,200 A 8/1996 Rangel
5,803,843 A 9/1998 Anderson et al.
5,823,902 A 10/1998 Guest et al.
5,859,119 A * 1/1999 Hoefflin ..... C08L 67/02 524/494
5,902,199 A 5/1999 Adams
5,987,724 A 11/1999 Kleman
6,017,284 A 1/2000 Giles
6,123,631 A * 9/2000 Ginder ..... F42B 6/06 473/570
6,390,642 B1 5/2002 Simonton
6,736,742 B2 5/2004 Price et al.
7,021,784 B2 * 4/2006 DiCarlo ..... F21V 33/008 362/109
7,189,170 B1 3/2007 Korsa et al.
7,211,011 B1 5/2007 Sutherland
D595,803 S 7/2009 Giles
7,632,199 B2 * 12/2009 Kikos ..... F42B 12/385 473/578
7,767,738 B2 * 8/2010 Gaggar ..... C08L 67/02 524/88
7,827,240 B1 11/2010 Atkins et al.
7,837,580 B2 * 11/2010 Huang ..... F42B 6/06 473/570
7,862,457 B1 1/2011 Urcheck
7,922,609 B1 4/2011 Hajari
7,931,550 B2 * 4/2011 Lynch ..... F42B 6/06 473/570
D641,827 S 7/2011 Errett
7,993,224 B2 * 8/2011 Brywig ..... F42B 6/06 473/570
D664,625 S 7/2012 Minica
8,267,816 B1 9/2012 Hajari
8,337,342 B1 12/2012 Huang
8,342,990 B1 1/2013 Price
8,366,573 B2 2/2013 Hunt
8,540,594 B2 9/2013 Chu
8,622,855 B2 1/2014 Bednar et al.
8,758,177 B2 6/2014 Minica
8,777,786 B1 * 7/2014 Bay ..... F42B 6/06 473/578
8,845,464 B1 9/2014 Hyde
D717,389 S 11/2014 Huang
8,951,152 B1 2/2015 Huang
8,994,944 B2 2/2015 Pedersen et al.
9,140,527 B2 9/2015 Pedersen et al.
9,151,580 B2 10/2015 Pedersen
9,212,874 B1 12/2015 Harding
9,243,875 B2 1/2016 Minica
9,255,753 B2 2/2016 Yehle
9,279,647 B2 3/2016 Marshall
9,279,648 B2 3/2016 Marshall
9,279,649 B2 3/2016 Bay
9,285,195 B1 * 3/2016 Palomaki ..... F42B 6/06
9,383,159 B2 7/2016 Yehle
9,404,720 B2 8/2016 Pedersen
9,423,219 B2 8/2016 Pedersen et al.
9,434,334 B2 * 9/2016 Marur ..... B60R 19/18
9,441,925 B1 9/2016 Palomaki et al.
9,470,486 B2 10/2016 Bednar et al.
RE46,213 E 11/2016 Hajari
9,494,380 B1 11/2016 Yehle
9,518,806 B2 12/2016 Pedersen
9,546,851 B2 * 1/2017 Kim ..... F42B 12/382
9,557,134 B1 1/2017 Yehle
9,568,290 B2 2/2017 Marshall
9,677,859 B1 * 6/2017 Kim ..... F42B 6/06
9,689,638 B1 6/2017 Yehle
9,714,818 B2 * 7/2017 Mook ..... F42B 6/06
9,733,051 B2 8/2017 Bay
9,879,936 B2 1/2018 Yehle
9,897,423 B2 * 2/2018 Bay ..... F42B 6/06
9,949,379 B2 4/2018 Kim et al.
2004/0184274 A1 9/2004 DiCarlo
2008/0287229 A1 * 11/2008 Donahoe ..... F41B 5/14 473/570
2010/0113195 A1 5/2010 Rezmer
2011/0218063 A1 9/2011 Hunt
2012/0100942 A1 * 4/2012 Minica ..... F42B 6/06 473/570
2013/0267359 A1 * 10/2013 Pedersen ..... F42B 6/06 473/570
2014/0187362 A1 * 7/2014 Pedersen ..... F42B 12/382 473/570
2015/0192395 A1 7/2015 Beck
2015/0308798 A1 10/2015 Kim
2017/0314899 A1 11/2017 Bay

OTHER PUBLICATIONS

U.S. Appl. No. 13/799,518, filed Mar. 13, 2013, Energy Storage Device for a Bow, U.S. Pat. No. 9,255,753, Feb. 9, 2016.
U.S. Appl. No. 61/820,792, filed May 8, 2013, Cocking Mechanism for a Bow.
U.S. Appl. No. 14/071,723, filed Nov. 5, 2013, De-Cocking Mechanism for a Bow, U.S. Pat. No. 9,383,159, Jul. 5, 2016.
U.S. Appl. No. 15/171,391, filed Jun. 2, 2016, Cocking Mechansim for a Crossbow.
U.S. Appl. No. 14/107,058, filed Dec. 16, 2013, String Guide System for a Bow, U.S. Pat. No. 9,354,015, May 31, 2016.
U.S. Appl. No. 62,244,932, filed Oct. 22, 2015, String Guide for a Bow.
U.S. Appl. No. 15/098,537, filed Apr. 14, 2016, Crossbow, U.S. Pat. No. 9,494,379, Nov. 15, 2016.
U.S. Appl. No. 15/098,557, filed Apr. 14, 2016, String Control System for a Crossbow, U.S. Pat. No. 9,494,380, Nov. 15, 2016.
U.S. Appl. No. 15/098,568, filed Apr. 14, 2016, Reduced Friction Trigger for a Crossbow, U.S. Pat. No. 9,557,134, Jan. 31, 2017.
U.S. Appl. No. 15/098,577, filed Apr. 14, 2016, Anti-Dry Fire System for a Crossbow.
U.S. Appl. No. 15/294,993, filed Oct. 17, 2016, String Guide for a Bow.
U.S. Appl. No. 15/395,705, filed Dec. 30, 2016, Torque Control System for Cocking a Crossbow.
U.S. Appl. No. 15/395,794, filed Dec. 30, 2016, Cocking System for a Crossbow.
U.S. Appl. No. 15/395,835, filed Dec. 30, 2016, Crossbow.
U.S. Appl. No. 15/433,769, filed Feb. 15, 2017, Crossbow.
U.S. Appl. No. 15/673,784, filed Aug. 10, 2017, Arrow Assembly for a Crossbow and Methods of Using Same.
U.S. Appl. No. 15/782,238, filed Oct. 12, 2017, Cocking System for a Crossbow.
U.S. Appl. No. 15/782,259, filed Oct. 12, 2017, Crossbow with Pulleys that Rotate Around Fixed Axes.
U.S. Appl. No. 15/821,372, filed Nov. 22, 2017, Bow.
U.S. Appl. No. 29,594,119, filed Feb. 15, 2017, Nock for an Archery Arrow.
U.S. Appl. No. 15/631,004, filed Jun. 23, 2017, High Impact Strength Nock Assembly.
U.S. Appl. No. 15/631,016, filed Jun. 23, 2017, High Impact Strength Lighted Nock Assembly.
U.S. Appl. No. 29,627,147, filed Nov. 22, 2017, Nock for an Archery Arrow.
U.S. Appl. No. 15/171,391, filed Jun. 2, 2016, Cocking Mechanism for a Crossbow.
U.S. Appl. No. 15/098,577, filed Apr. 14, 2016, Anti-Dry Fire System for a Crossbow, U.S. Pat. No. 9,689,638.
U.S. Appl. No. 15/294,993, filed Oct. 17, 2016, String Guide for a Bow, U.S. Pat. No. 9,879,936.
U.S. Appl. No. 15/395,705, filed Dec. 30, 2016, Torque Control System for Cocking a Crossbow, 2017/0108307.

(56) References Cited

OTHER PUBLICATIONS

U.S. Appl. No. 15/395,794, filed Dec. 30, 2016, Cocking System for a Crossbow, 2017/0122695.
U.S. Appl. No. 15/395,835, filed Dec. 30, 2016, Crossbow, 2017/0122691.
U.S. Appl. No. 15/433,769, filed Feb. 15, 2017, Crossbow, 2017/0160042.
U.S. Appl. No. 15/673,784, filed Aug. 10, 2017, Arrow Assembly for a Crossbow and Methods of Using Same, 2018/0051955.
U.S. Appl. No. 15/782,238, filed Oct. 12, 2017, Cocking System for a Crossbow, 2018/0051956.
U.S. Appl. No. 15/782,259, filed Oct. 12, 2017, Crossbow with Pulleys that Rotate Around Fixed Axes, 2018/0051954.
U.S. Appl. No. 15/821,375, filed Nov. 22, 2017, Bow.
U.S. Appl. No. 15/909,872, filed Mar. 1, 2018, Reduced Length Crossbow.
U.S. Appl. No. 16/021,443, filed Jun. 28, 2018, Crossbow.
U.S. Appl. No. 16/021,475, filed Jun. 28, 2018, Silent Cocking System for a Crossbow.

* cited by examiner

HIGH IMPACT STRENGTH LIGHTED NOCK ASSEMBLY

REFERENCE TO RELATED APPLICATIONS

The present application claims the benefit of U.S. Prov. Application Ser. No. 62/459,421, entitled High Impact Strength Lighted Nock, filed Feb. 15, 2017 and U.S. Prov. Application Ser. No. 62/492,671, entitled High Impact Strength Lighted Nock, filed May 1, 2017, the entire disclosures of which are hereby incorporated by reference.

FIELD OF THE INVENTION

The present disclosure is directed to a lighted nock constructed from a transparent or semi-transparent, reinforced, high impact strength polymeric material (or blend of polymeric materials) for use in bows and crossbows.

BACKGROUND OF THE INVENTION

Lighted arrow nocks, such as disclosed in U.S. Pat. No. 8,777,786 (Bay) and U.S. Pat. No. 9,279,649 (Bay), allow an archer to be able to more easily see the arrow in flight, see the point of arrow impact, and recover the arrow after a shot. Being able to observe the arrow in flight and see the point of impact helps the archer to diagnose problems with shooting form or bow setup and make appropriate adjustments. Perhaps more importantly, a lighted arrow nock allows an archer to more easily recover the arrow.

Bow hunters can especially benefit from using an arrow with a lighted nock device. Recovering an arrow that was shot at an animal is critical in the ethical harvest of animals, and a lighted nock device allows a bow hunter to recover the arrow and animal more easily. Upon recovering the arrow, the bow hunter can diagnose many things about the shot by inspecting the arrow.

As vertical bows and crossbows (referred to collectively herein as "bows") have gotten more powerful current lighted nock products have demonstrated an inability to handle the forces generated during launch. If a nock breaks on launch the energy stored in the bow is not absorbed (or is only partially absorbed) by the arrow, resulting in a full or partial "dry fire" event. In a dry fire event some or all of the energy stored by the bow is absorbed by the bow itself, especially the limbs and the riser. Shattered limbs and crack risers are common outcomes of a dry fire event. Dry fire events are often catastrophic for the bow.

Many existing lighted nock systems have components that transfer forces to the inside surface of the arrow shaft, causing arrow shaft fractures, such as U.S. Pat. No. 7,021,784 (DiCarlo) and U.S. Pat. No. 9,546,851 (Kim). Some lighted nock systems that rely on nock translation to activate the light also require the entire light assembly to be removed from the arrow to deactivate the light. Most of the lighted nock systems suffer from unintended activation of the light, such as during transport, which can drain the battery.

BRIEF SUMMARY OF THE INVENTION

The present disclosure is directed to a lighted nock constructed from a transparent or semi-transparent, reinforced, high impact strength polymeric material. The lighted hocks are molded with a recess configured to receive a variety of light-weight light assemblies.

The present disclosure is directed to a high impact strength lighted nock assembly for an arrow that is activated when the arrow is fired with a bowstring. The nock is molded from a transparent, high impact strength polymeric material containing at least 10% by weight reinforcing material. The nock includes a head configured to engage with the bowstring and a shank configured to couple with a rear end of the arrow. The shank includes a recess extending from a distal end of the shank toward the head. A light assembly includes a light emitting device electrically coupled to a battery. The light emitting device is located in the recess in the shank. The light emitting device is in a deactivated state before the arrow is fired and, an activated state after the arrow is fired.

The polymeric material can be one of polycarbonate, polyurethane, polyetherimide, nylon, polyetheretherketone, polyetherketone, thermoplastic polyimide, or combinations thereof.

In one embodiment the reinforcing material is about 20% by weight glass fibers or filamentous glass. The polymeric material preferably has a tensile strength of greater than about 10,000 pounds per square inch (psi) as determined by ASTM D638. The polymeric material preferably includes a flexural strength of greater than about 20,000 psi as determined by ASTM D790. The polymeric material preferably includes a flexural modulus of greater than $0.50\times10^6$ psi as determined by ASTM D790.

A portion of the light emitted by the light emitting device is transmitted through the nock and a portion of the light is scattered by the reinforcing material. The polymeric material preferably has a light transmittance of at least 75%. The reinforcing material preferably has an average aspect ratio of at least about 5:1, and more preferably at least about 10:1.

In one embodiment, the lighted nock assembly includes a bushing interposed between the nock and the rear end of the arrow. The battery is at least partially located in a center opening in the bushing.

In one embodiment, the light assembly is normally biased to a deactivated configuration. In one embodiment, there is a gap between the head of the nock and the rear of the arrow before the arrow is fired. Displacement of the head of the nock toward the rear of the arrow after the, arrow is fire biases the light assembly to an activated configuration. The light assembly preferably automatically returns to the deactivated configuration when the gap between the head of the nock and the rear of the arrow is reestablished.

The one embodiment a switch electrically coupling the light emitting device to the battery is triggered when the arrow is fired to convert the light emitting device from the deactivated state to the activated state. In another embodiment, the switch includes at least one accelerometer that is triggered when the arrow is fired. In one embodiment, the switch includes at least two accelerometers acting along orthogonal axes to convert the light emitting device from the deactivated state to the activated state The present disclosure is also directed to a high impact strength lighted nock assembly for an arrow that is activated when the arrow is fired with a bowstring. The lighted nock assembly includes a nock molded from a high impact strength, transparent polymeric material containing about 20% by weight reinforcing material, wherein the polymeric material includes a tensile strength of greater than about 10,000 pounds per square inch (psi) as determined by ASTM D638 and a flexural strength of greater than about 20,000 psi as determined by ASTM D790. The nock includes a head configured to engage with the bowstring and a shank configured to couple with a rear end of the arrow. The shank comprising a recess extending in a distal end of the shank toward the head. A light assembly includes a light emitting device electrically coupled to a battery. The light emitting device is located in the recess in the shank. The light emitting device is in a deactivated state before the arrow is fired and an activated state after the arrow is fired.

The present disclosure is directed to a high impact strength nock assembly that couples with, and decouples from, a bushing mounted in an arrow. The forces applied to the nock during launch are translated to the arrow through the bushing, greatly extending arrow life. The present high impact strength nock assembly can be used with or without a light assembly.

In one embodiment, the nock translates within the bushing during launch to activate a light assembly. A removable stop tab is provided to prevent unintended activation of the light, such as during transport. The light can be deactivated by simply translating the nock back to a deactivated position, without removing the lighted nock assembly from the bushing. The entire lighted nock assembly is removable from the bushing for maintenance and replacement.

The lighted nock assembly includes a light assembly with a light emitting device that is mechanically coupled to a battery. Displacing the light emitting device toward the battery activates the light emitting device, and displacing the light emitting device away from the battery deactivates the light emitting device. The nock includes a head configured to engage with a bowstring. The nock has a shank, with a recess sized to receive the light assembly. The light emitting device is attached to the nock inside the recess. A bushing is sized for insertion into a shaft of the arrow. The bushing has a shoulder that engages with a rear end of the shaft and a center opening sized to frictionally engage with the shank of the nock. A battery stop is coupled to the battery and releasably coupled within the center opening of the bushing to resist longitudinal translation of the battery relative to the bushing. In use, the nock translates within the center opening between an activated configuration that activates the light emitting device and a deactivated configuration that deactivates the light emitting device, without removing the light assembly from the bushing.

In one embodiment a friction member is located between the battery stop and the bushing to releasably secure the battery to the bushing. In another embodiment, an O-ring is located in opposing recesses in the battery stop and the center opening of the bushing to releasably secure the battery to the bushing. The light assembly, nock, and battery stop are removable from the bushing as a single assembly by overcoming the resistance of the friction, member or the O-ring.

In one embodiment, a removable tab stop is located in a gap between the head of the nock and the shoulder of the bushing that prevents the nock from translating to the activated configuration. The tab stop includes a handle portion large enough to prevent the nock from being engaged with a crossbow trigger housing. In another embodiment, the handle portion, has at least one major dimension that is at least about two times greater than an outside diameter of the shaft.

Because the lighted nock assembly is contained within the bushing, forces applied to the nock during translation from the deactivated configuration and the activated configuration are transmitted to the shaft entirely through the, bushing. The nock is preferably molded from a transparent, high impact strength polymeric material containing at least 10% by weight reinforcing material. In one embodiment, the reinforcing material comprise about 20% by weight glass fibers or filamentous glass.

The present disclosure is also directed to a plurality of matched weight arrows, with and without the light assembly. A first arrow has the bushing and the lighted, nock assembly discussed herein. A second arrow has a bushing and a nock located in the bushing. The first arrow has substantially the same weight as the second arrow, such that the arrows of substantially identical flight characteristics.

The present disclosure is also directed to a high impact strength lighted nock assembly that couples with, and decouples from, a bushing mounted in a rear end of an arrow. The lighted nock assembly includes a light assembly with a light emitting device that is mechanically coupled to a battery. Displacing the light emitting device toward the battery activates the light emitting device and displacing the light emitting device away from the battery deactivates the light emitting device. The nock includes a head configured to engage with a bowstring and a shank with a recess sized to receive the light assembly. The light emitting, device is attached to the nock inside the recess. A battery stop is coupled to the battery and releasably coupled within the center opening of the bushing to resist longitudinal translation of the battery relative to the bushing. In use, the nock translates within the center opening between an activated configuration that activates the light emitting device and a deactivated configuration that deactivates the light emitting device without removing the light assembly from the bushing. The lighted nock assembly is removable from the bushing as a single assembly.

The present disclosure is also directed to a kit including a plurality of interchangeable lighted nock assemblies that are compatible with the bushing. A user can remove a lighted nock assembly form the bushing and replace it with a different lighted nock assembly, while preserving the arrow. For example, the lighted nock assembly may be replaced with one having, a different color light emitting device or for maintenance purposes.

The present disclosure is also directed to a method of preparing an arrow. The method includes mounting a bushing in a rear end of a shaft, where the bushing has a shoulder that, engages with the rear end of the shaft. The present lighted nock assembly is, inserted into the, center opening in the bushing, such that the battery stop resists longitudinal translation of the battery relative to the bushing. The nock is translated within a center opening in the bushing between an activated configuration that activates the light emitting device and the deactivated configuration that deactivates the light emitting device without removing the light assembly from the bushing.

The present disclosure is also directed to a method of preparing a plurality of matched weight arrows. The method includes preparing a first arrow with the present lighted nock assembly. A second arrow is prepared by mounting a second bushing in the second arrow and inserting a nock into the second bushing. The first arrow has a first weight substantially the same as the weight of the second arrow.

DETAILED DESCRIPTION OF THE INVENTION

Figure 1:
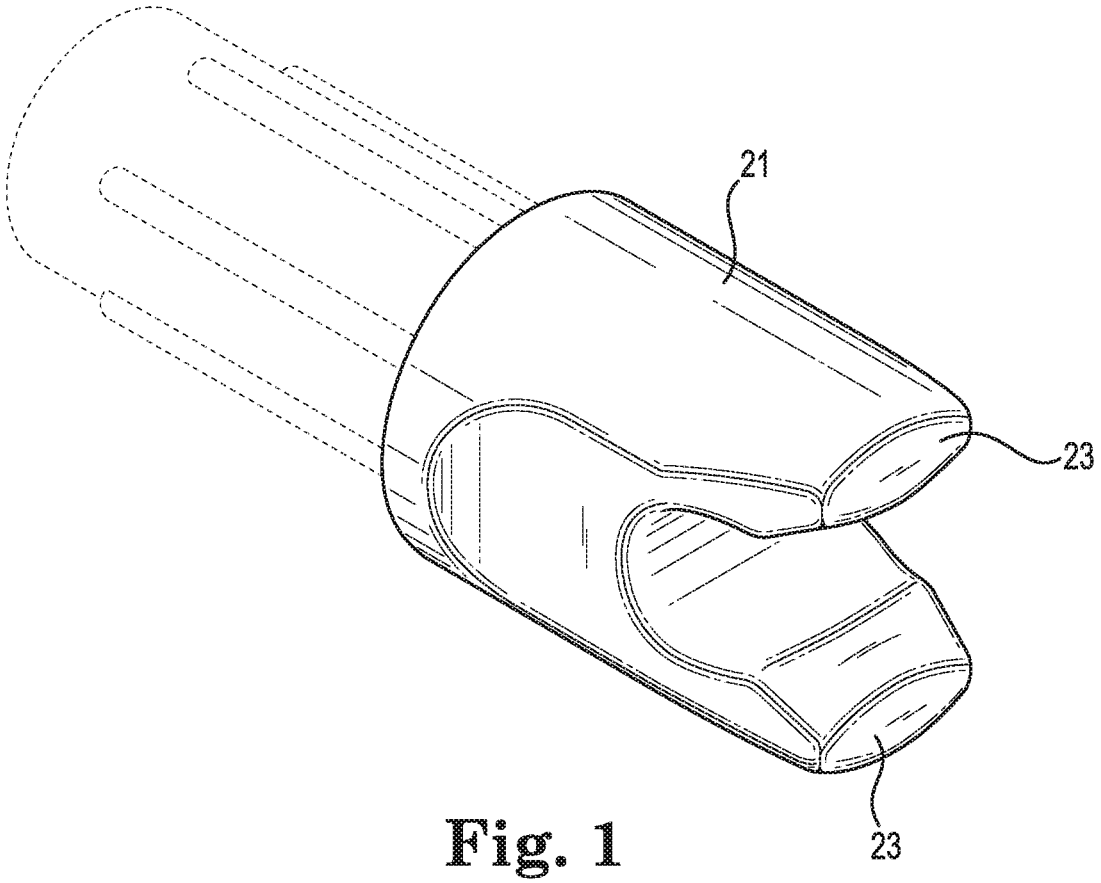
FIG. 1 is a perspective view of a nock for an archery arrow in accordance with an embodiment of the present disclosure.
Figure 2:
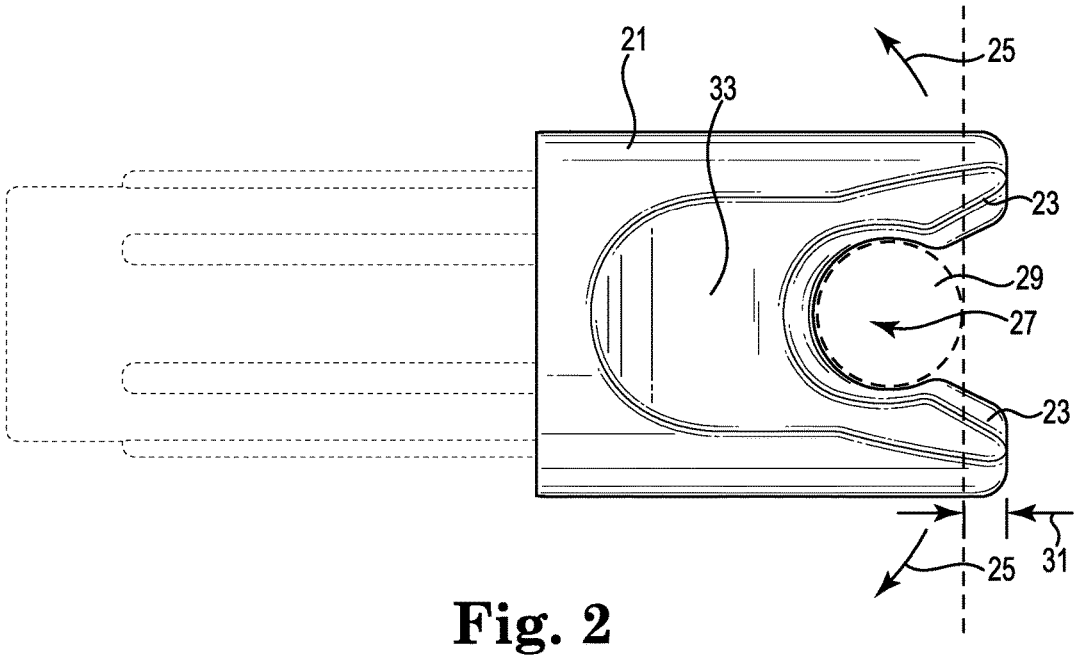
FIG. 2 is a top view of the nock of FIG. 1.

FIGS. 1 through 5 illustrate various views of an exemplary nock 21 in accordance with an embodiment of the present disclosure. The nock 21 is molded from a reinforced polymeric material (or blend of polymeric materials). The nock 21 can be used with or without, a light assembly, as will be discussed herein.

For lighted nock applications, the reinforced polymeric material is preferably transparent, but may also be semi-transparent or translucent. Light transmittance of the polymeric material is preferably at least 65%, more preferably at least 75%, and most preferably at least 85%. Nocks for vertical bows and crossbows arc, often distinguished in their general shape, but both are collectively referred to herein as "nocks". As used herein. the term "bows" refers generically to both vertical bows and crossbows.

The nock 21 illustrated in FIGS. 1-5 is a clip-on nock. The prongs 23 flex outward 25 until the bowstring is seated in semi-circular opening 27. In order to withstand the forces generated in high-powered bows, the polymeric material must have a high impact strength, but also requires sufficient flexibility to permit the nock prongs 23 to deflect when engaging with and disengaging from the bowstring 29. The polymeric material preferably has a tensile strength of greater than about 10,000 pounds per square inch (psi) as determined by ASTM D638. The polymeric material preferably has a flexural strength of greater than about 20,000 psi as determined by ASTM D790. The polymeric material preferably has a flexural modulus of greater than $0.50\times10^6$ psi. The flexural modules is the ratio, within the elastic limit, of stress corresponding to strain.

The reinforcing material can be plastic, metal, ceramic, glass, wood, and/or natural and synthetic composite material, and so forth, as well as combinations thereof. For example, reinforcing material can, be glass, carbon, titanium, aluminum, stainless steel, talc, mica, quartz, Wollastonite, as well, as combinations thereof. The form of the reinforcing material can be fibers (including woven, non-woven (e.g., felt), chopped, continuous, and/or random fibers), flakes, beads, particles, and combinations thereof. In one embodiment, the reinforcing material has an average aspect ratio (i.e., the ratio of a structure's size in different dimensions) of at least about 5:1, and more preferably at least about 7:1, and most preferably about 10:1.

In one embodiment, the nock 21 is molded from a high impact, transparent polycarbonate material filled with between about 10% to about 30% by weight reinforcing material. In one embodiment, the reinforcing material is about 20% by weight glass fibers or filamentous glass. The glass fibers preferably have diameters in the range of about 5 microns to about 100 microns and a length of less than about 2 millimeters. One polymeric material suitable for the present high impact nock is available from RTP Company of Winona, Wis. under the product designation RTP 303. While the material is substantially transparent, it exhibits a slight yellow tint. Polyurethane, polyetherimide, nylon, polyetheretherketone, polyetherketone, and thermoplastic polyimide may also be used. Other polymeric materials suitable for the present nock 21 are disclosed in U.S. Pat. No. 9,434,334 (Marur et al.); U.S. Pat. No. 7,767,738 (Gagger et al.) and U.S. Pat. No. 5,859,119 (Hoefflin), which are hereby incorporated by reference.

Transparency is the physical property of allowing light to pass through a material without being scattered. Translucency, on the other hand, allows light to pass through, but the photons can be scattered either at interfaces where there is a change in index of refraction or internally. The nock 21 is preferably constructed from a polymeric material that is transparent (or transparent to certain wavelengths of light due to color tinting of the polymer), while the reinforcing material scatters some portion of the light from the light emitting device. Consequently, portions of the nock 21 both transparent and translucent. That is, a portion of the light emitted by the light emitting device is transmitted through the nock 21 and a portion of the light is scattered by the reinforcing material.

By altering the percentage of reinforcing material in the polymeric material it is possible to engineer the optimum balance of transmitted light (which creates more directional light source that is visible at a greater distance) and scattered light (which creates a hemispheric distribution of light that is visible from more angles). Applicants have identified a reinforcing material content of about 10% to about 30% by weight as providing optimal light distribution for lighted nock applications.

Figure 3:
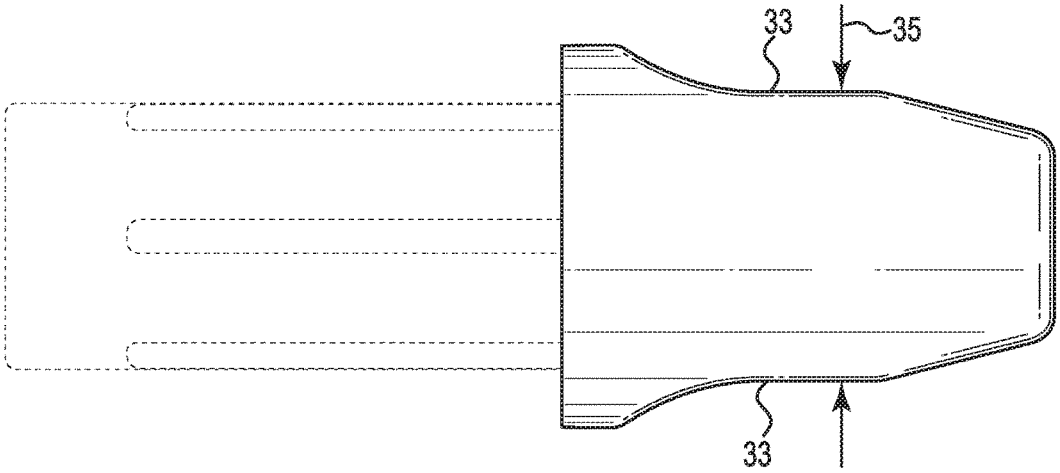
FIG. 3 is a side view of the nock of FIG. 1.
Figure 4:
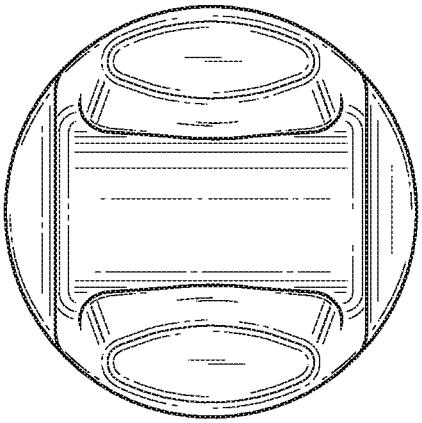
FIG. 4 is an end view of the nock of FIG. 1.
Figure 5:
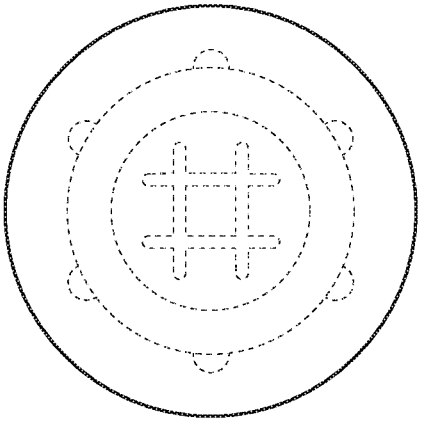
FIG. 5 is an end view of the nock of FIG. 1.

The nock 21 illustrated in FIGS. 1-5 may be used with the crossbows illustrated in U.S. Pat. No. 9,494,379 (Yehle) entitled Crossbow, filed Apr. 14, 2016 and U.S. patent application Ser. No. 15/433,769 entitled Crossbow, filed Feb. 15, 2017, both of which are hereby incorporated by reference. In particular, the anti-dry fire mechanism disclosed in the patents noted above preferably engages with the nock 21 in the region 31 behind the bowstring 29. The region 31 is preferably at least about 0.1 inches. Flat regions 33 illustrated in FIG. 3 are preferably separate by a distance 35 of about 0.250 inches, which corresponds to a gap between fingers on a bowstring catch for the crossbow in the patents noted above.

Figure 6A:
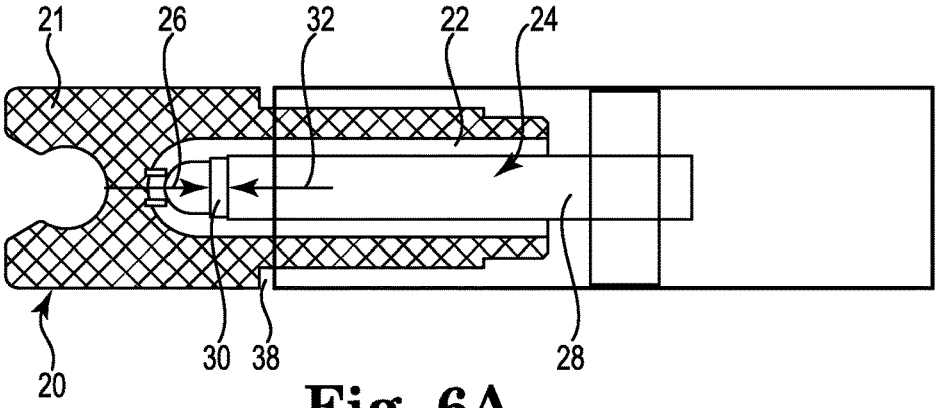
FIGS. 6A and 6B are sectional views of a lighted nock assembly in accordance with an embodiment of the present disclosure.
Figure 6B:
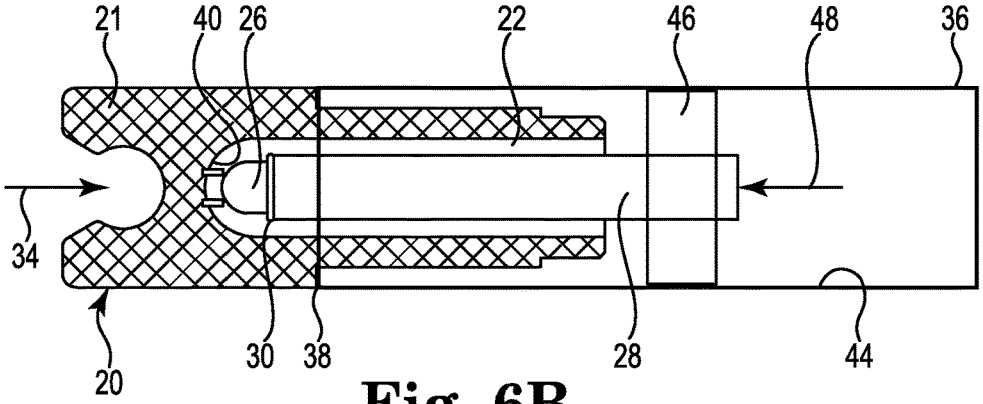

FIG. 6A and 6B are cross-sectional views of the lighted nock assembly 20 in accordance with an embodiment of the present disclosure. In the illustrated embodiment, the light assembly 24 is a "bobber-light" that includes light emitting device 26, such as a filament light, an LED, or other light producing device, electrically coupled to battery 28. The nock 21 includes recess 22 configured to receive the light emitting device 26.

Figure 7A:
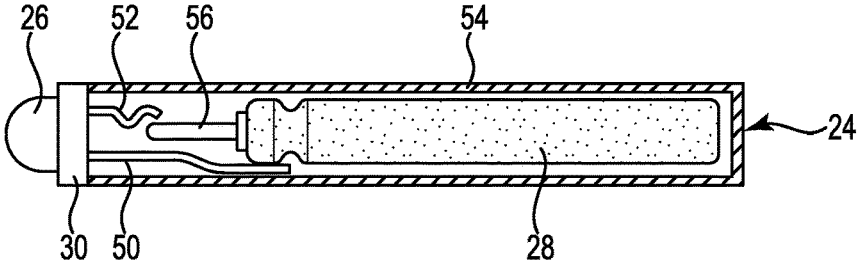
FIGS. 7A and 7B are sectional views of a light assembly in accordance with an embodiment of the present disclosure.

In the illustrated embodiment, elastomeric member 30 maintains gap 32 between light emitting device 26 and the battery 28 corresponding to the battery 28 being disconnected from the light emitting device 26 (see FIG. 7A). The light assembly 24 is biased to the deactivated configuration by the elastomeric member 30.

As best illustrated in FIG. 6B, on launch the bowstring (not shown) applies force 34 to displace the nock 21 into the arrow shaft 36, reducing or closing the gap 38. Bottom, surface 40 of the recess 22 simultaneously displaces the light emitting device 26 toward the battery 28 to complete the circuit and altering the light emitting device to an activated state (see e.g., FIG. 7B). Elastomeric insert 46 secures the battery 28 to the inside surface 44 of the arrow shaft 36 so as to create force 48 that opposes the force 34 applied to the light emitting device 26 by displacement of the nock 21. The opposing forces 34 and 48 compress the elastomeric material 30 and substantially closes the gap 32, resulting in the battery 28 being electrically coupled to the light emitting device 26 (see FIG. 7B). The light emitting device 26 is now in the activated state.

The light assembly 24 is moved to the deactivated configuration by pulling the nock 21 slightly out of the arrow shaft 36 as illustrated in FIG. 6A and reestablishing the gap 38. The elastomeric material 30 simultaneously displaces the light emitting device 26 away from the battery 28 and opens the circuit to deactivate the light emitting device 26 (see e.g., FIG. 7A). The light assembly 24 is normally biased to the deactivated configuration absent an external force.

Figure 7B:
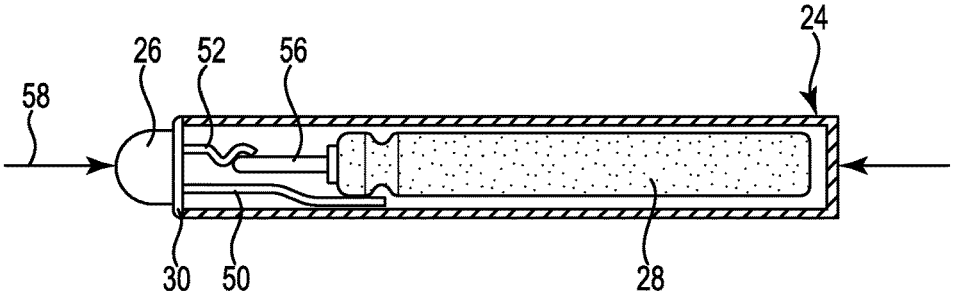

FIGS. 7A and 7B illustrate the light assembly 24 in accordance with an embodiment of the present disclosure. FIG. 7A illustrates the light assembly 24 in the deactivated configuration and FIG. 7B illustrates the activated configuration. The light emitting device 26 includes a pair of electrical contacts 50 and 52 that extend rearward within housing 54 toward the battery 28. In the illustrated embodiment the contact 50 is engaged with one pole of the battery 28 at all times. In the deactivated configuration the contact 52 is separated from the other pole 56 of the battery 28. The elastomeric member 30 maintains that separation. In another embodiment, a metal spring may be located generally concentrically around the pole 56 to serve as both the contact 50 and to provide the biasing force of the elastomeric member 30. In both embodiments the light assembly 24 is biased to the inactive configuration.

As illustrated in FIG. 7B, when the light assembly 24 is subject to a longitudinal compressive force 58 the elastomeric member 30 is elastically deformed and compressed a sufficient amount so the contact 52 engages with the other pole 56 of the battery 28, completing the circuit so the light emitting device 26 is in the activated state. When the longitudinal compressive force 58 is removed the elastomeric member 30 automatically returns to its original size and shape (see FIG. 7A), which displaces the contact 52 way from the pole 56 of the battery 28 to move the light emitting device 26 to the deactivated state.

In another embodiment, the light emitting device 26 is secured in the recess 22 in the nock 21. When the nock 21 is pulled away from the arrow shaft 36 and the gap 38 is reset, the light emitting device 26 and the contact 52 are also displaced away from the pole 56 of the battery 28 and the light emitting device 26 is in the deactivated state. The elastomeric member 30 is not required in this embodiment.

Figure 7C:
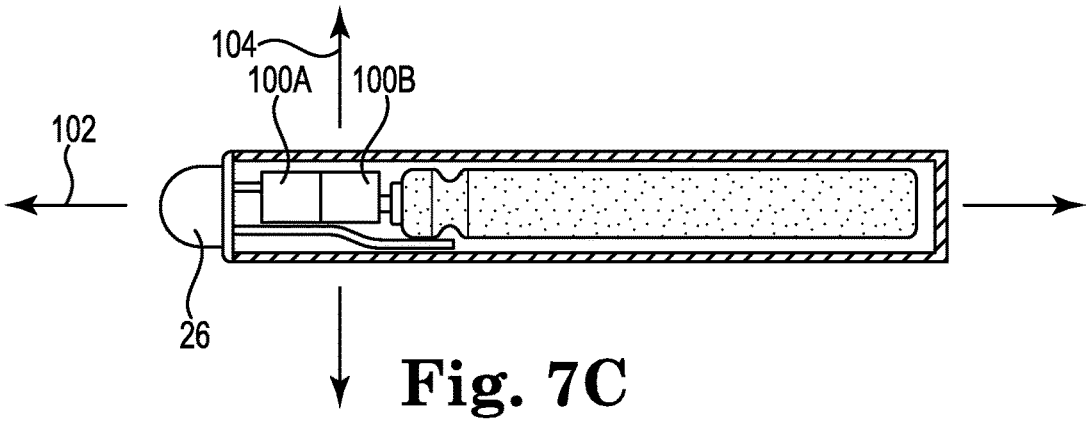
FIG. 7C is a sectional view of an alternate light assembly with multiple acceleration switches in accordance with an embodiment of the present disclosure.

In an alternate embodiment illustrated in FIG. 7C, one or more accelerometer switches or an integrated circuit accelerometer 100A, 100B ("100") control activation of the light emitting device 26, such as disclosed in U.S. Pat. No. 7,993,224 (Brywig), which is hereby incorporated by reference. The switches 100 respond to the forces resulting from the acceleration of the arrow upon release or deceleration of the arrow upon impact with a target. In one embodiment, multiple accelerometer switches 100 are provided to sense acceleration and/or deceleration along multiple axes 102, 104. For example, axis 102 may be located along a longitudinal axis of the arrow and the axis 104 is perpendicular to the axis 102. Triggering of the light emitting device 26 preferably requires a combination of acceleration and/or deceleration signals along the two different axes 102, 104.

Figure 8A:
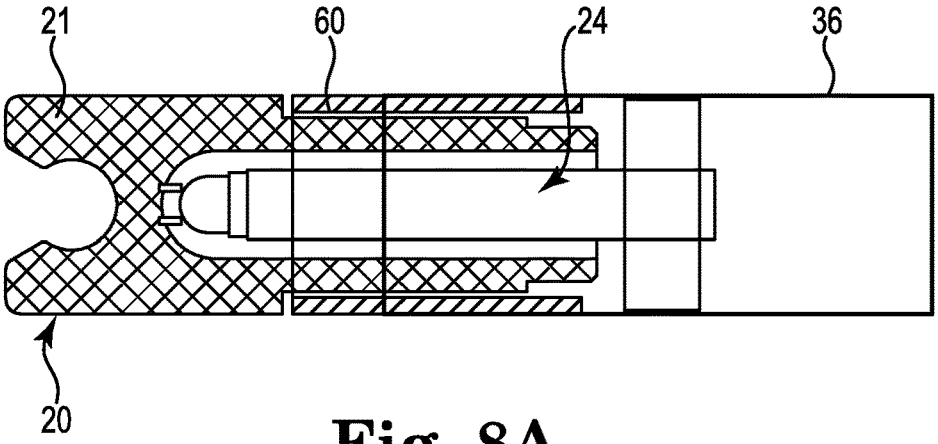
FIG. 8A is a sectional view of a combination lighted nock assembly and bushing in accordance with an embodiment of the present disclosure.
Figure 8B:
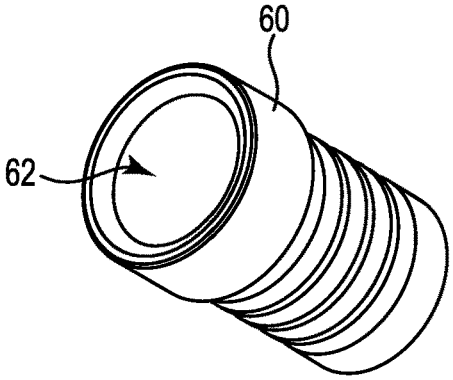
FIG. 8B is a perspective view of the bushing of FIG. 8A.

FIGS. 8A and 8B illustrate an alternate lighted nock assembly 20 used in combination with bushing 60 in accordance with an embodiment of the present disclosure. The bushing 60 is a hollow cylinder that is interposed between the nock 21 and the arrow shaft 36 to reinforce the shaft 36. The light assembly 24 extends through center opening 62 in the bushing 60. The bushing 60 is preferably aluminum or other light-weight metal.

The present disclosure is not limited to the light assemblies 24 illustrated herein. The present lighted nock assembly 20 can be modified to operate with a variety of light assemblies, including without limitation the light assemblies disclosed in U.S. Pat. No. 4,340,930 (Carissimi); U.S. Pat. No. 4,547,837 (Bennett); U.S. Pat. No. 5,134,552 (Call et al.); U.S. Pat. No. 6,123,631 (Ginder); U.S. Pat. No. 6,736,742 (Price et al.); U.S. Pat. No. 7,021,784 (DiCarlo); U.S. Pat. No. 7,211,011 (Sutherland); U.S. Pat. No. 7,837,580 (Huang); U.S. Pat. No. 7,931,550 (Lynch); U.S. Pat. No. 7,927,240 (Lynch); U.S. Pat. No. 7,993,224 (Brywig); U.S. Pat. No. 8,342,990 (Price); U.S. Pat. No. 8,540,594 (Chu); U.S. Pat. No. 8,758,177 (Minica); U.S. Pat. No. 8,777,786 (Bay); U.S. Pat. No. 8,944,944 (Pedersen et al.); U.S. Pat. No. 9,140,527 (Pedersen et al.); U.S. Pat. No. 9,151,580 (Pedersen): U.S. Pat. No. 9,243,875 (Minica); U.S. Pat. No. 9,279,647 (Marshall); U.S. Pat. No. 9,279,648 (Marshall); U.S. Pat. No. 9,279,649 (Bay); U.S. Pat. No. 9,404,720 (Pedersen); U.S. Pat. No. 9,423,219 (Pedersen et al.); U.S. Pat. No. 9,518,806 (Pedersen); U.S. Pat. No. 9,546,851 (Kim); 2015/0192395 (Beck), which are hereby incorporated by reference.

The present disclosure is applicable to any nock configuration, including without limitation, flat, half-moon. slotted, and universal nocks, such as disclosed in U.S. Pat. No. 9,441,925 (Palomaki et al.); U.S. Pat. No. 9,285,195 (Palornaki et al.); U.S. Pat. No. 9,212,874 (Harding); U.S. Pat. No. 8,622,855 (Bednar et al.); U.S. Pat. No. 7,189,170 (Korsa et al.); U.S. Pat. No. 5,803,843 (Anderson et al.); U.S. Pat. No. D717,389 (Huang); U.S. Pat. No. D664,625 (Minica); U.S. Pat. No. D641,827 (Errett); and U.S. Pat. No. D595,803 (Giles), which are hereby incorporated by reference.

Figure 9:
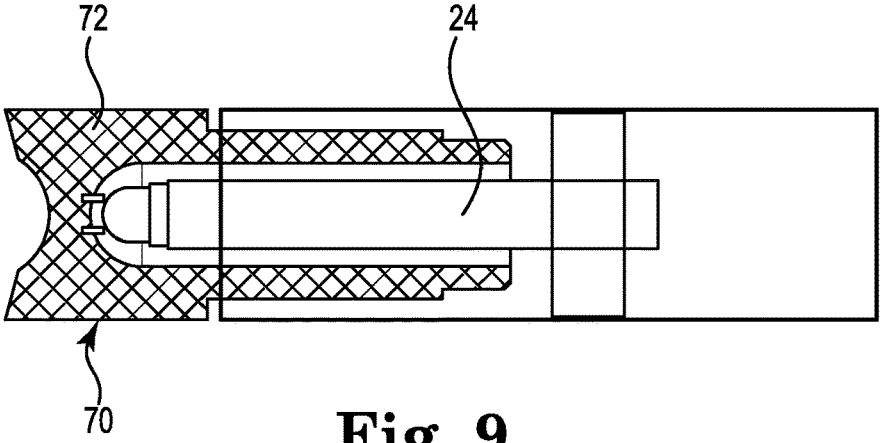
FIG. 9 is a sectional view of a lighted nock assembly for a half-moon nock in accordance with an embodiment of the present disclosure.
Figure 10:
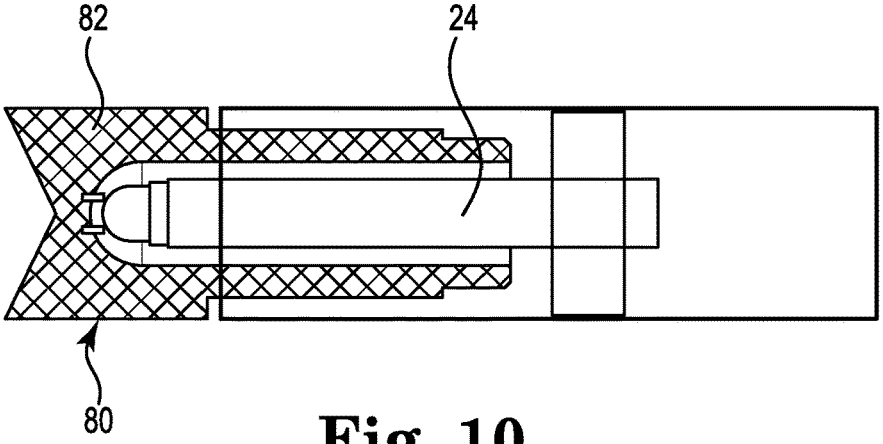
FIG. 10 is a sectional view of a lighted nock assembly for a V-nock in accordance with an embodiment of the present disclosure.
Figure 11:
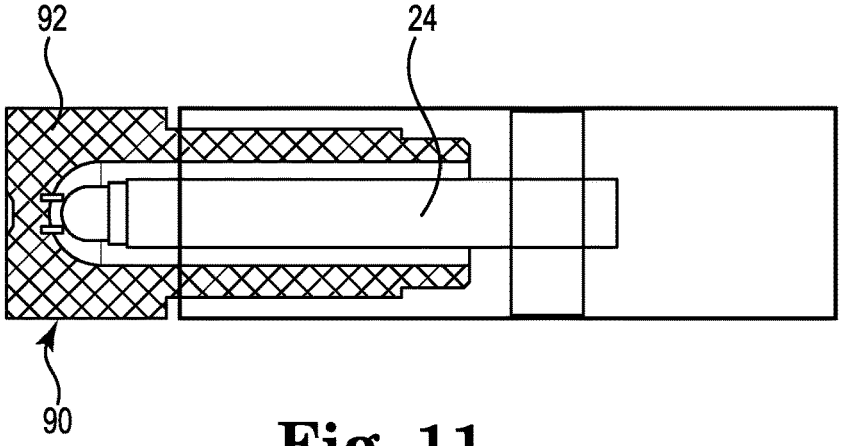
FIG. 11 is a sectional view of a lighted nock assembly for a flat nock in accordance with an embodiment of the present disclosure.

FIG. 9 illustrates a lighted nock assembly 70 including a light assembly 24 and a half-moon nock 72 in accordance with an embodiment of the present, disclosure. FIG. 10 illustrates a lighted nock assembly 80 including a light assembly 24 and a V-nock 82 in accordance with an embodiment of the present disclosure. FIG. 11 illustrates a lighted nock assembly 90 including a light assembly 24 and a flat nock 92 in accordance with an embodiment of the present disclosure.

Figure 12A:
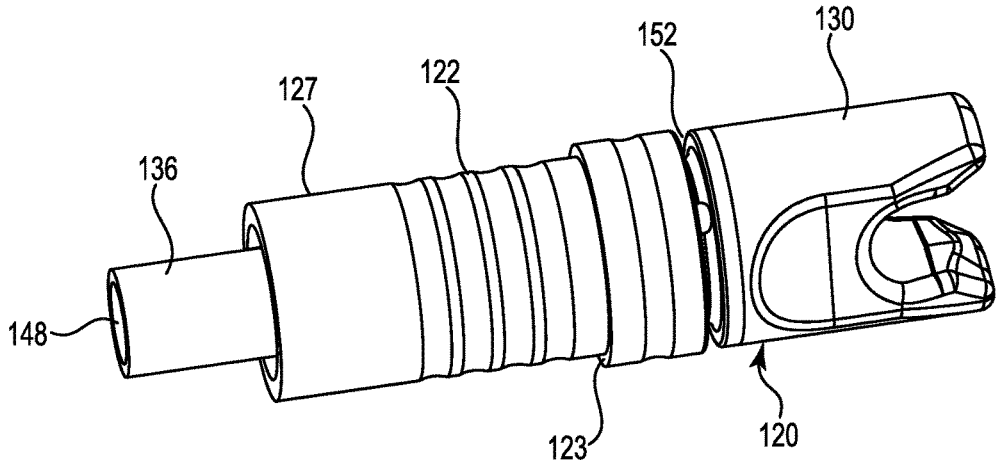
FIG. 12A is a perspective view of an alternate lighted nock assembly used with a bushing in accordance with an embodiment of the present disclosure.
Figure 12B:
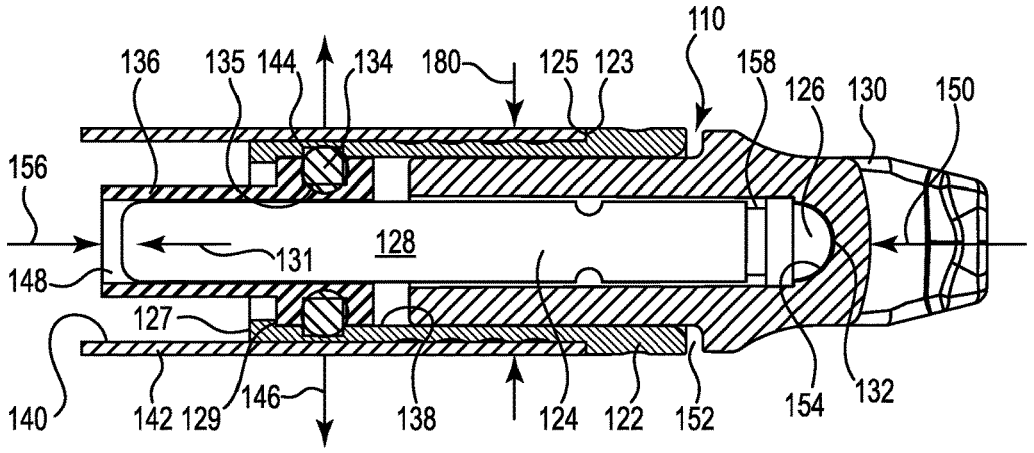
FIG. 12B is cross-sectional view of the lighted nock assembly of FIG. 12A in a deactivated configuration in accordance with an embodiment of the present disclosure.
Figure 12C:
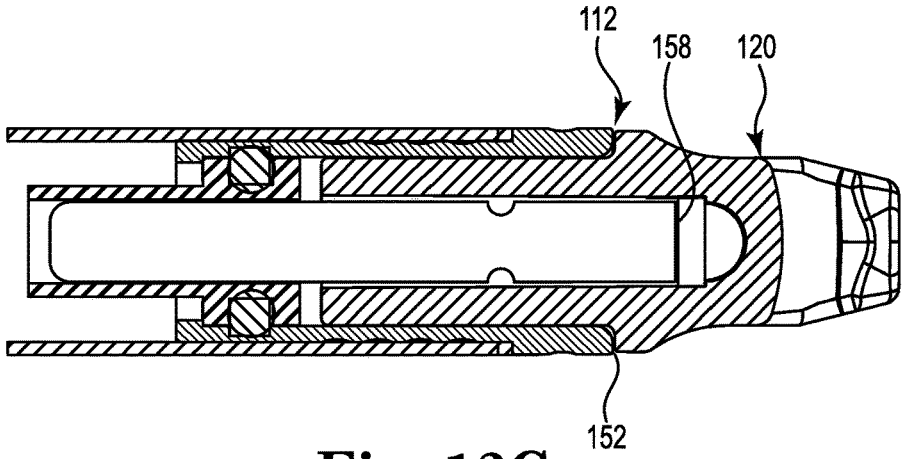
FIG. 12C is cross-sectional view of the lighted nock assembly of FIG. 12A in an activated configuration in, accordance with an embodiment of the present disclosure.

FIGS. 12A through 12C illustrate an alternate lighted nock assembly 120 used in combination with bushing 122 in accordance with an embodiment of the present disclosure. The bushing 122 is preferably constructed from a light weight metal and is sized to be receive within arrow shaft 142. In the illustrated embodiment, the bushing 122 includes shoulder 123 that engages with rear end 125 of the arrow shaft 142.

Figure 15:
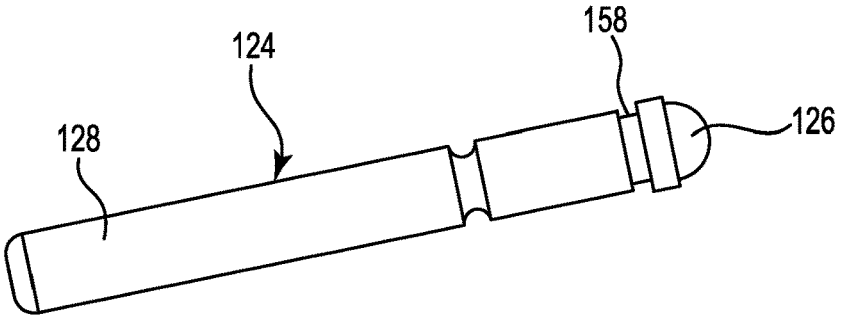
FIG. 15 illustrates the light assembly of FIG. 12A.

In the illustrated embodiment, the light assembly 124 is a "bobber-light" that includes light emitting device 126, such as a filament light, an LED, or other light producing device, electrically coupled to battery 128. See also, FIG. 15. The light emitting device 126 is mechanically coupled to a battery 128. Displacing the light emitting device 126 toward the battery 128 activates the light emitting device 126 and displacing the light emitting device 126 away from the battery 128 deactivates the light emitting device. FIG. 12B illustrates the lighted nock assembly 120 in a deactivated configuration 110 and FIG. 12C illustrates the lighted nock assembly 120 in an activated configuration 112. as will be discussed further herein.

Figure 14B:
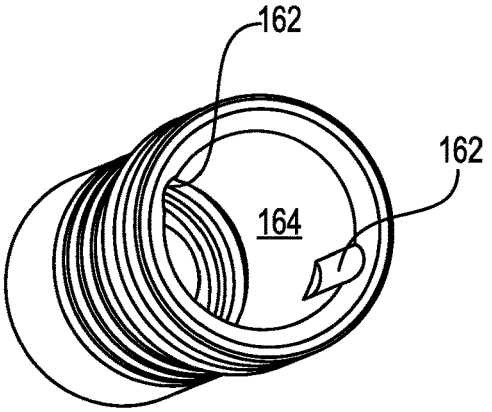
FIGS. 14A and 14B illustrate an interface of the bushing and the nock of FIG. 12A.
Figure 14A:
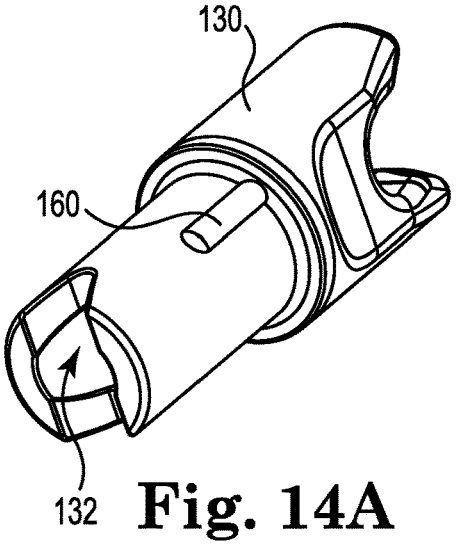

As best illustrated in FIG. 12B, the nock 130 includes recess 132 configured to receive the light assembly 124 (see also FIG. 14A). The light emitting device 126 is secured in the recess 132 using a variety of means, such as fasteners, adhesives, inter locking structures, and the like. Only the light emitting device 126 is attached to the nock 130 so the remainder of the light assembly 124 can move relative to the nock, as illustrated in FIG. 12C. The nock 130 is preferably molded from a transparent, high impact strength polymeric material, as discussed herein.

Battery 128 is secured to inside surface 138 of the bushing 122 by battery stop 136. The battery stop 136 is attached to the battery 128 at a location offset from the nock 130, even in the activated configuration 112. The battery stop 136 is a discrete component from the nock 130 and the bushing 122. Consequently, the nock 130 is coupled to the battery stop 136 by the battery 128, such that movement of the nock 130 relative to the bushing 122 is independent from the engagement of the battery stop 136 with the bushing 122.

Distal end 127 of the bushing 122 preferably includes a structure 129, such as a ridge or a shoulder that limits displacement of the battery stop 136 in direction 131. The tolerances on the battery stop 136 are such that it can slide within the bushing 122, but substantially limits radial displacement of the battery 128 within the arrow shaft 142. This configuration also serves to reinforce the nock 130 from torque applied by a bowstring. These forces are substantially contained within the bushing 122, rather than the arrow shaft 142.

In the illustrated embodiment, the battery 128 is glued to center opening 148 that extends through the battery stop 136. The center opening 148 permits the battery stop 136 to be slid along the battery 128 to the optimum location before being glued in place. It is also possible to use a longer battery 128 that extends past distal end, of the battery stop 136.

Figure 16A:
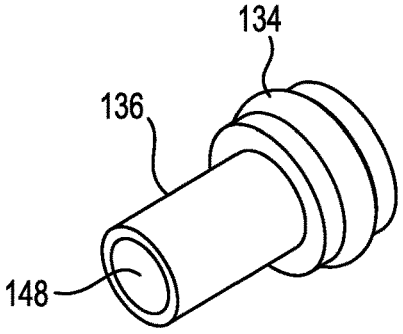
FIGS. 16A and 16B illustrate the battery stop of FIG. 12A.
Figure 16B:
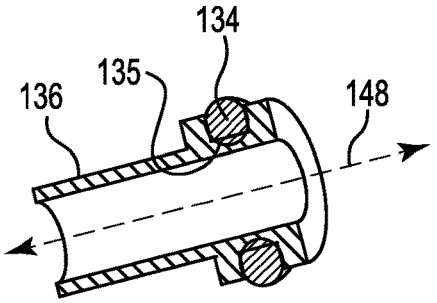

Friction member 134, such as an elastomeric O-ring, is located in recess 135 in the battery stop 136. See also, FIGS. 16A and 16B. The friction member 134 engages with inside surface 138 of the bushing 122 rather than inside surface 140 of the arrow shaft 142. In, the illustrated embodiment, inside surface 138 of the bushing 122 includes recess 144 that receives a portion of the friction member 134. Locating the O-ring 134 in the opposing recesses 135 144 resists longitudinal displacement of the battery 128 in the bushing 122 a sufficient amount to permit the nock 130 to be pulled to reset the gap 152 to the deactivated configuration 110, without removing the lighted nock assembly 120 from the bushing 122 (see FIG. 12C). By applying additional, pulling force to the nock 130, the entire lighted nock assembly 120 (light assembly 124, battery stop 136, and nock 130) can be removed from the bushing 122 and replaced.

Because the lighted nock assembly 120 is contained within the bushing 122, forces applied to the nock 130 during launch are transmitted to the shaft 142 through the bushing 122. For example, radial outward forces 146 transmitted to the battery stop 136 and friction member 134 are contained by the bushing 122, rather than the arrow shaft 142. Many existing lighted nock systems have components that transfer forces to the inside surface of the arrow shaft, causing arrow shaft fractures. The present system isolates the forces generated by the nock 130 within the bushing 122, so any forces experience by the nock 130 are transmitted to the arrow shaft 142 by the bushing 122, greatly extending arrow life. When combined with a nock molded from a transparent. high impact strength polymeric material, the present lighted nock assembly 120 is suitable for use with high-powered bows and crossbows.

On launch the bowstring (not shown) applies force 150 that displaces the nock 130 into the arrow shaft 142 to the activated configuration 112 shown in FIG. 12C, reducing or closing the gap 152. Bottom surface 154 of the recess 132 simultaneously displaces the light emitting device 126 toward the battery 128, completing the circuit and placing the light emitting device 126 to an activated state. The friction member 134 secures the battery 128 to the inside surface 138 of the bushing 122 so as to create force 156 that opposes the force 150 applied to the light emitting device 126 by displacement of the nock 130. The opposing forces 150 and 156 displace the light emitting device 126 toward the battery 128 to substantially reduce or close the gap 158 and to activate the light emitting device 126.

The light assembly 124 is moved to the deactivated configuration 110 by pulling the nock 130 slightly out of the arrow shaft 142 to reestablish the gap 152, as illustrated in FIG. 12B. The friction member 134 secures the battery stop 136 that is attached to the battery 128 within the bushing 122 in opposition to the nock 130 being pulled away from the bushing 122. Consequently, the light emitting device 126 can be deactivated without removing the light assembly 124 from the bushing 122.

Figure 13A:
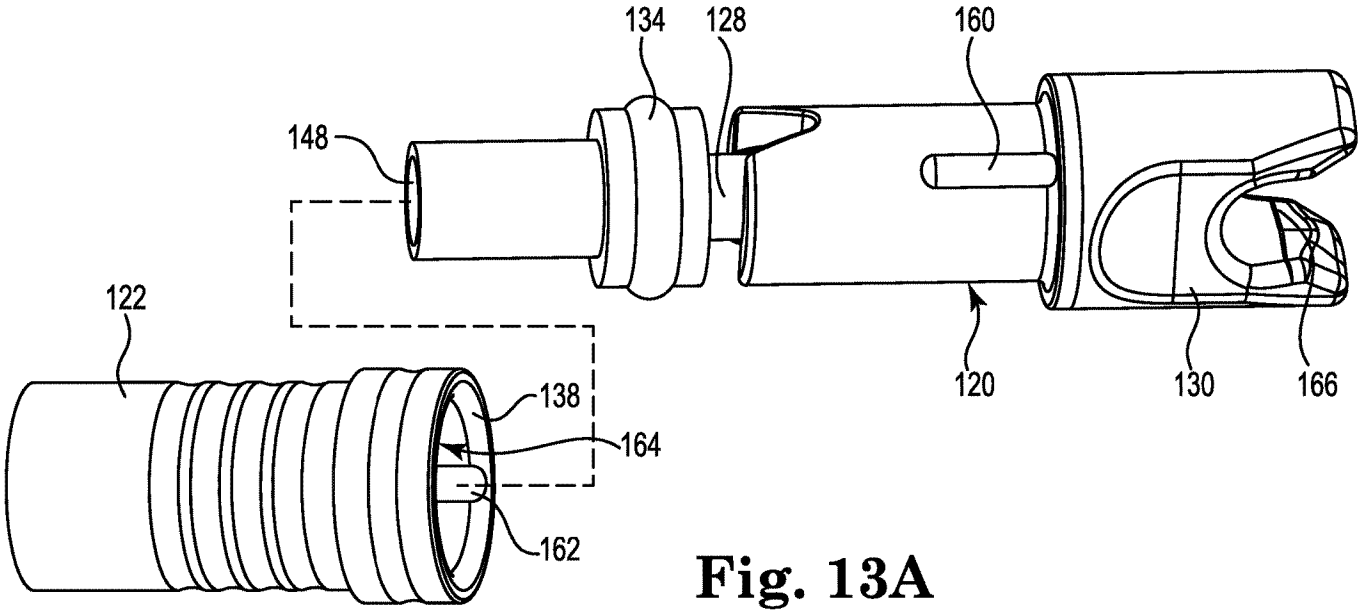
FIG. 13A is an exploded view of the lighted nock assembly of FIG. 12A.
Figure 13B:
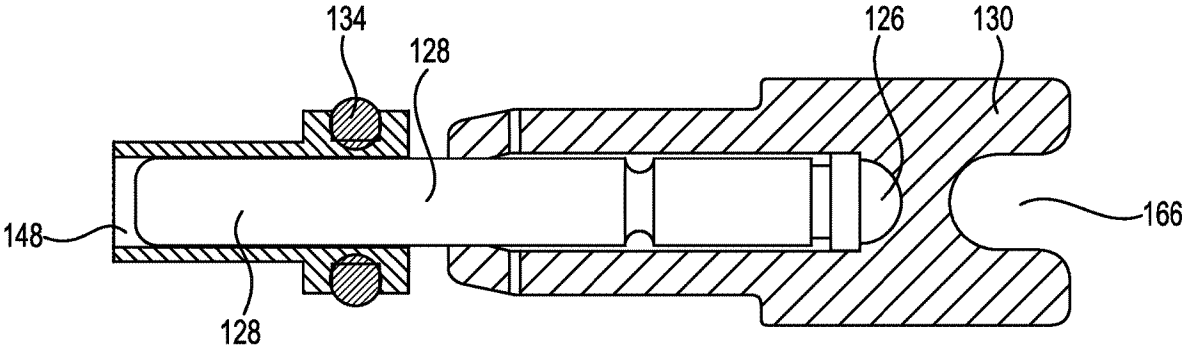
FIG. 13B is a sectional view of the lighted nock assembly of FIG. 1 without the bushing.

FIGS. 13A and 13B show the lighted nock assembly 120 separated from the bushing 122. Since the battery stop 136 is glued to the battery 128 and the LED 126 is glued to the nock 130, the entire lighted nock assembly 120 can be removed from the bushing 122. In the event the light assembly 124 is not working or the nock 130 damaged, the user can pull the entire lighted nock assembly 120 from the bushing 122 by overcoming the frictional coupling generated by the friction member 134 engaged with the recess 144 (see FIG. 12B) in the bushing 122. A replacement lighted nock assembly 120 is then re-inserted into the bushing 122. This configuration permits the bushing 122 to be permanently attached, such as with an adhesive, to the arrow shaft 142 (see FIG. 12B).

The nock 130 preferably includes one or more ridges 160 that mate with corresponding grooves 162 located on inside surface 138 in center opening 164 of the bushing 122. The ridges 160 and grooves 162 prevent the nock 130 from rotating axially relative to the bushing 122 so the nock opening 166 is retained in the correct orientation relative to the arrow shaft 142. See also, FIGS. 14A and 14B.

Figure 17A:
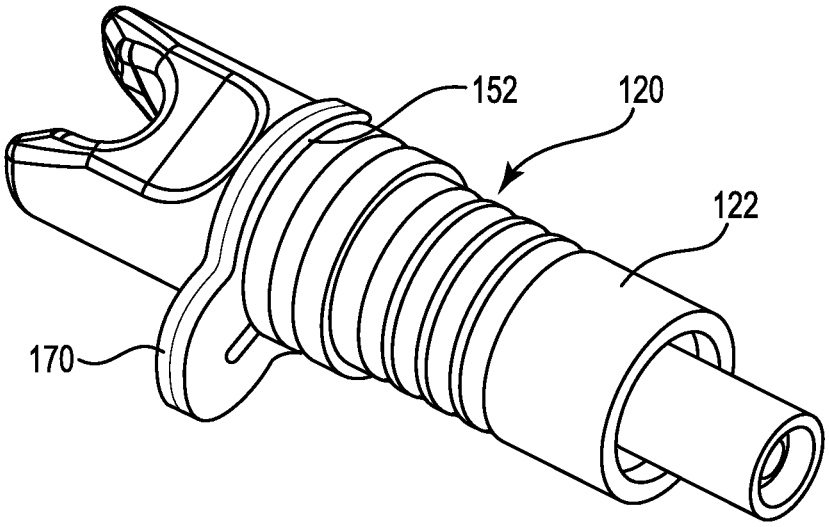
FIGS. 17A and 17B illustrate a tab stop for use with a lighted nock assembly in accordance with an embodiment of the present disclosure.
Figure 17B:
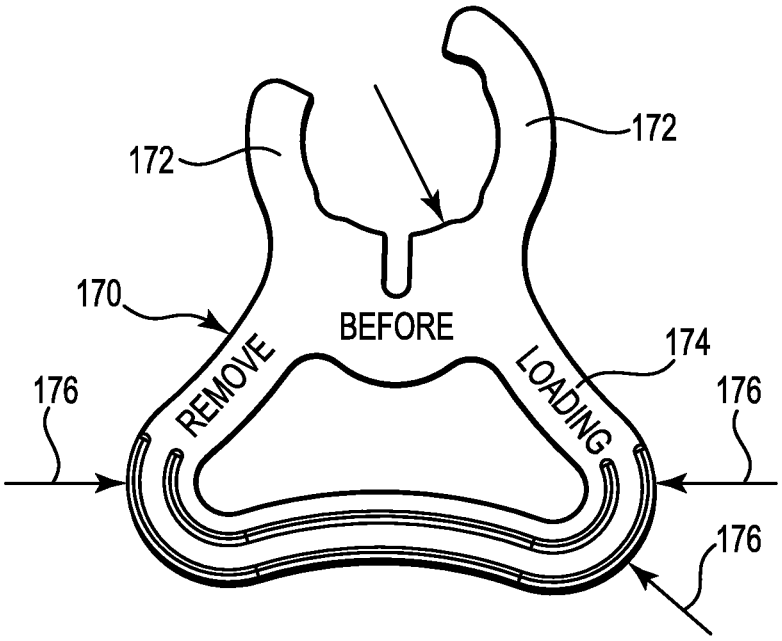

FIGS. 17A and 17B illustrate the lighted nock assembly 120 and the bushing 122 with stop tab 170 located in the gap 152 (see FIG. 12A) to prevent inadvertent activation of the light assembly 124. The tab stop 170 is useful for shipping purposes and for carrying arrows containing the present lighted nock assembly 120 in the field. The stop tab 170 includes one or more arms 172 that wrap around the stem of the nock 130 and block the gap 152 from closing. The arms 172 are designed to flex outward during insertion into, and removal from, the gap 152.

In the illustrated embodiment, the tab stop 170 includes a handle portion 174 that is large enough to prevent the nock 130 from being engaged with a crossbow trigger housing, forcing the user to remove the tab stop 170 before flocking the arrow. The handle portion 174 preferably has at least one major dimension 176 that is at least about two times an outside diameter 180 of the arrow shaft 142 (see FIG. 12B) coupled to the nock 130, and more preferably at least about three times the outside diameter of the arrow shaft.

Figure 18:
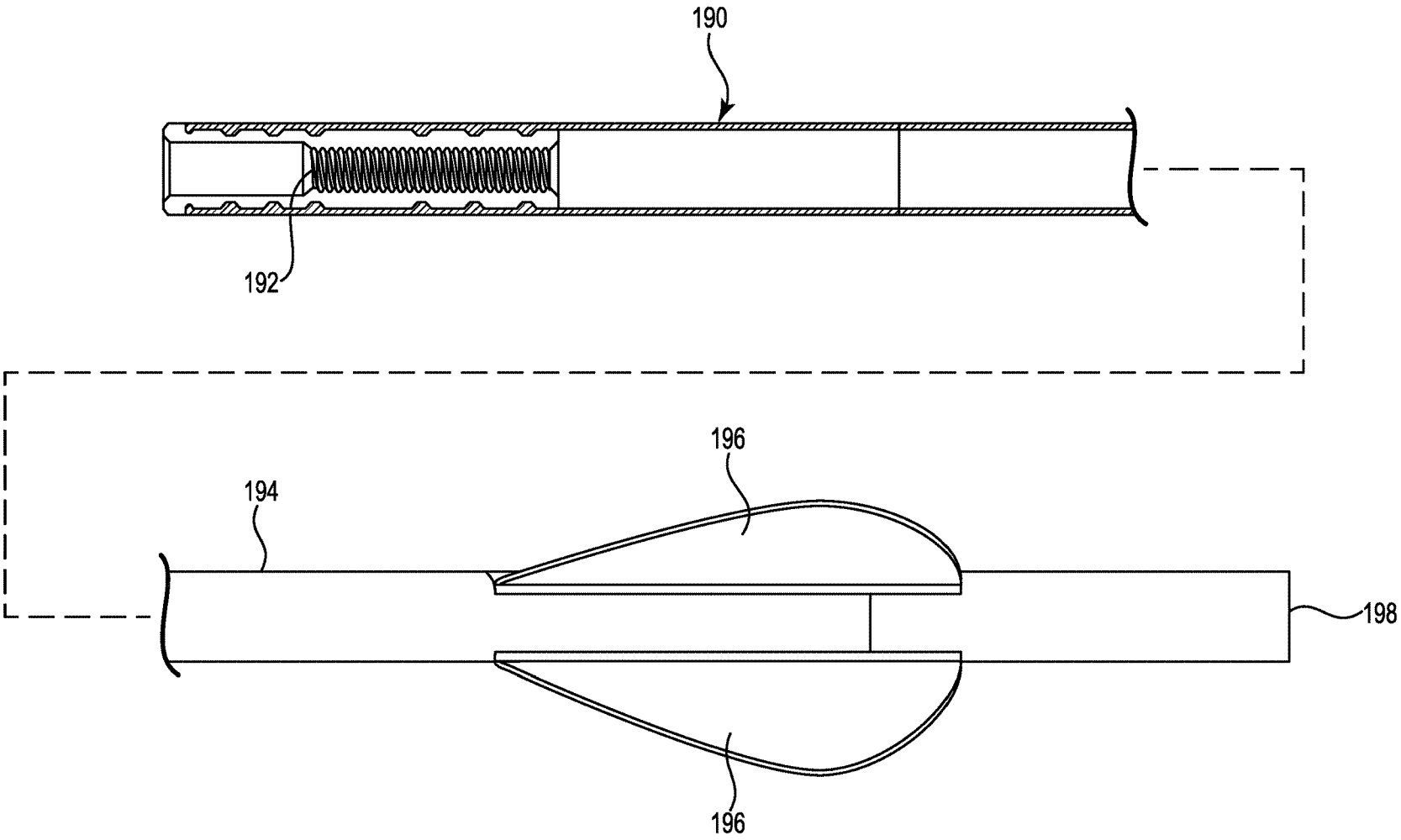
FIG. 18 illustrates a matched weight arrow that can be used with or without a lighted nock assembly in accordance with an embodiment of the present disclosure.

FIG. 18 illustrates a matched weight arrow 190 that can be both lighted and non-lighted, in accordance with an embodiment of the present disclosure. As used herein, "matched weight arrows" refers to a plurality of arrows with the same functional characteristics, such as for example, length, stiffness, weight, and diameter, that exhibit substantially similar flight characteristics when launch from the same bow. The present matched weight arrows 190 have a weight difference of less than about 10%, more preferably less than about 5%. and most preferably less than about 2%. In operation, matched weight arrows can be used interchangeable without adjusting the sight or scope on the bow.

The arrow 190 includes a threaded front insert 192 that receives an arrow head (not shown), a shaft 194, fletching 196, and a rear opening 198 configured to receive any of the, bushings and/or pocks ,disclosed herein. The present matched weight arrow 190 is configured to have substantially the same weight, whether used with our without the present lighted nock assembly 120, so their flight characteristics are the substantially the same. Consequently, a user can select either a lighted arrow or a non-lighted arrow without having to compensate for different weight arrows.

For a non-lighted arrow 190, for example, the bushing 60 (see FIG. 8B) and the nock 21 (FIG. 1) are inserted into the rear opening 198, without the lighted nock assembly 120.

For a lighted arrow 190, for example, the present lighted nock assembly 120 and bushing 122 is inserted into the rear opening 198. Since the lighted nock assembly 120 and bushing 122 are heavier than just the nock 21 and bushing 60, weight is preferably removed elsewhere from the lighted arrow, such as from the shaft 194, the threaded front, insert 192, or the fletching 196, so the lighted arrow weighs substantially the same as a non-lighted arrow. In one embodiment, weight is removed from the front insert 192 of the lighted arrow to offset the weight added by the lighted nock assembly 120. In one embodiment, the rear bushing 122 used with the lighted arrow assembly 120 is lighter than the bushing 60, to offset some or all of the weight difference. In another embodiment, weight is added to the non-lighted arrows, such for example, in the threaded front insert 192 or the rear bushing 60, equal to the amount of weight added by the lighted nock assembly 120 and bushing 122. Consequently, the user can carry both lighted arrows and non-lighted arrows having substantially the same weight and flight characteristics. These matched weight arrows 190 can be used interchangeable without effecting, accuracy.

Where a range, of values is provided, it is understood that each intervening value, to the tenth of the unit of the lower limit unless the context clearly dictates otherwise, between the upper and lower limit of that range and any other stated or intervening value in that stated range is encompassed within this disclosure. The upper and lower limits of these smaller ranges which may independently be included in the smaller ranges is also encompassed within the disclosure, subject to any specifically excluded limit in the stated range. Where the stated range includes one or both of the limits, ranges excluding either both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the various methods and materials are, now described, All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosure is not entitled to antedate such publication by virtue of prior invention. Further, the dates of publication provided may be different from the actual publication dates which may need to be independently confirmed.

Other embodiments are possible. Although the description above contains much specificity, these should not be construed as limiting the scope of the disclosure, but as merely providing illustrations of some of the presently preferred embodiments. It is also contemplated that various combinations or sub-combinations of the specific features and aspects of the embodiments may be made and still fall within the scope of this disclosure. It should be understood that various features and aspects of the disclosed embodiments can be combined with or substituted for one another in order to form varying modes disclosed. Thus, it is intended that the scope of at least some of the present disclosure should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described, preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the, present disclosure is intended to be dedicated to the public regardless of whether the element, component, or method step is explicitly recited in the claims.

What is claimed is:

1. A high impact strength lighted nock assembly for an arrow that is activated when the arrow is fired with a bowstring, the lighted nock assembly comprising:

a nock molded from a transparent, high impact strength polymeric material containing at least 10% by weight reinforcing material, the nock comprising a head configured to engage with the bowstring and a shank configured to couple with a bushing extending into a rear end of the arrow, the shank comprising a recess extending in a distal end of the shank toward the head;

a light assembly comprising a light emitting device located in the recess in the shank that is electrically coupled to a battery, wherein the light emitting device is in a deactivated state before the arrow is fired and an activated state after the arrow is fired; and a battery stop attached to the battery at a location offset from the nock and releasable coupled within a center opening of the bushing to resist longitudinal translation of the battery relative to the bushing, wherein the nock translates within the center opening between an activated configuration that activates the light emitting device and a deactivated configuration that deactivates the light emitting device without removing the light assembly from the bushing.

2. The lighted nock assembly of claim 1 wherein the polymeric material comprises one of polycarbonate, polyurethane, polyetherimide, nylon, polyetheretherketone, polyetherketone, thermoplastic polyimide, or combinations thereof.

3. The lighted nock assembly of claim 1 wherein the reinforcing material comprise about 20% by weight glass fibers or filamentous glass.

4. The lighted nock assembly of claim 1 wherein the reinforcing material comprises an average aspect ratio of at least about 5:1.

5. The lighted nock assembly of claim 1 wherein the reinforcing material comprises an average aspect ratio of at least about 10:1.

6. The lighted nock assembly of claim 1 wherein the polymeric material comprises a tensile strength of greater than about 10,000 pounds per square inch (psi) as determined by ASTM D638.

7. The lighted nock assembly of claim 1 wherein the polymeric material comprises a flexural strength of greater than about 20,000 psi as determined by ASTM D790.

8. The lighted nock assembly of claim 1 wherein the polymeric material comprises a flexural modulus of greater than $0.50\times10^6$ psi as determined by ASTM D790.

9. The lighted nock assembly of claim 1 wherein a portion of the light emitted by the light emitting device is transmitted through the nock and a portion of the light is scattered by the reinforcing material.

10. The lighted nock assembly of claim 1 wherein the polymeric material comprises a light transmittance of at least 75%.

11. The lighted nock assembly of claim 1 comprising a bushing interposed between the nock and the arrow, wherein the battery is at least partially located in a center opening in the bushing.

12. The lighted nock assembly of claim 1 wherein the light assembly is normally biased to a deactivated configuration.

13. The lighted nock assembly of claim 1 comprising a gap between the head of the nock and the rear of the arrow before the arrow is fired, wherein displacement of the head of the nock toward the rear of the arrow after the arrow is fired biases the light assembly to an activated configuration.

14. The lighted nock assembly of claim 13 wherein the light assembly automatically returns to the deactivated configuration when the gap between the head of the nock and the rear of the arrow is reestablished.

15. The lighted nock assembly of claim 1 comprising a switch electrically coupling to the light emitting device to the battery that is triggered when the arrow is fired to convert the light emitting device from the deactivated state to the activated state.

16. The lighted nock assembly of claim 1 comprising a switch electrically coupling to the light emitting device to the battery, wherein the switch comprises at least one accelerometer that is triggered when the arrow is fired to convert the light emitting device from the deactivated state to the activated state.

17. The lighted nock assembly of claim 16 wherein the switch comprises at least two accelerometers acting along orthogonal axes.

18. A high impact strength lighted nock assembly for an arrow that is activated when the arrow is fired with a bowstring, the lighted nock assembly comprising:

a nock molded from a high impact strength, transparent polymeric material containing about 20% by weight reinforcing material, wherein the polymeric material comprises a tensile strength of greater than about 10,000 pounds per square inch (psi) as determined by ASTM D638 and a flexural strength of greater than about 20,000 psi as determined by ASTM D790, the nock comprising a head configured to engage with the bowstring and a shank configured to couple with a bushing extending into a rear end of the arrow, the shank comprising a recess extending from a distal end of the shank toward the head;

a light assembly comprising a light emitting device located in the recess in the shank that is electrically coupled to a battery, wherein the light emitting device is in a deactivated state before the arrow is fired and an activated state after the arrow is fired; and a battery stop attached to the battery at a location offset from the nock and releasably coupled within a center opening of the bushing to resist longitudinal translation of the battery relative to the bushing, wherein the nock translates within the center opening between an activated configuration that activates the light emitting device and a deactivated configuration that deactivates the light emitting device without removing the light assembly from the bushing.

19. A high impact strength lighted nock assembly for an arrow that is activated when the arrow is fired with a bowstring, the lighted nock assembly comprising:

a nock molded from a transparent, high impact strength polymeric material containing at least 10% by weight reinforcing material, the nock comprising a head configured to engage with the bowstring, a shank configured to couple with a bushing extending into a rear end of the arrow, the shank extending in a distal end of the arrow toward the head; and a light assembly comprising a light emitting device that is electrically coupled to a battery, wherein the light emitting device is in a deactivated state before the arrow is fired and an activated state after the arrow is fired; and a battery stop attached to the battery at a location offset from the nock and releasably coupled within a center opening of the bushing to resist longitudinal translation of the battery relative to the bushing, wherein the nock translates within the center opening between an activated configuration that activates the light emitting device and a deactivated configuration that deactivates the light emitting device without removing the light assembly from the bushing.

* * * * *